US008915050B2

(12) United States Patent
Walsh et al.

(10) Patent No.: US 8,915,050 B2
(45) Date of Patent: Dec. 23, 2014

(54) PACKING PROCESS AND APPARATUS FOR MULTIPLE ROWS OF HORIZONTALLY STACKED PRODUCTS

(75) Inventors: Michael J. Walsh, Atlanta, GA (US); D'Anthony K. Moore, Douglasville, GA (US)

(73) Assignee: Maxwell Chase Technologies, LLC, Atlanta, GA (US)

( * ) Notice: Subject to any disclaimer, the term of this patent is extended or adjusted under 35 U.S.C. 154(b) by 734 days.

(21) Appl. No.: 13/239,857

(22) Filed: Sep. 22, 2011

(65) Prior Publication Data

US 2013/0074453 A1 Mar. 28, 2013

(51) Int. Cl.

| | |
|---|---|
| ***B65B 35/30*** | (2006.01) |
| ***B65B 25/04*** | (2006.01) |
| *B65B 5/06* | (2006.01) |
| *B65B 7/16* | (2006.01) |

(52) U.S. Cl.

CPC ..... *B65B 35/30* (2013.01); *B65B 25/04* (2013.01); *B65B 5/06* (2013.01); *B65B 7/162* (2013.01)

USPC ..... 53/443; 53/446; 53/447

(58) Field of Classification Search

CPC ..... B65B 5/10; B65B 5/108; B65B 23/10; B65B 23/12–23/16; B65B 25/06; B65B 25/065; B65B 25/068; B65B 35/30–35/50; B65B 35/56

USPC ..... 53/443–444, 446–448, 475, 147, 158, 53/169, 531–532, 534, 539, 542–544, 53/246–248, 254–255, 260, 435, 513–517

See application file for complete search history.

(56) References Cited

U.S. PATENT DOCUMENTS

| | | | | |
|---|---|---|---|---|
| 3,258,046 | A | 6/1966 | Lackerman | |
| 4,048,784 | A * | 9/1977 | Toby | 53/77 |
| 4,184,397 | A | 1/1980 | Jones | |
| 4,346,634 | A | 8/1982 | Jones | |
| 4,416,103 | A * | 11/1983 | Ewer et al. | 53/517 |
| 4,436,011 | A | 3/1984 | Jones | |
| 4,768,328 | A * | 9/1988 | Mims | 53/532 |
| 5,012,628 | A * | 5/1991 | Van Oord | 53/448 |
| 5,150,563 | A * | 9/1992 | Hartness | 53/539 |
| D388,665 | S | 1/1998 | So | |
| 6,052,969 | A * | 4/2000 | Hart et al. | 53/447 |
| 6,322,316 | B1 * | 11/2001 | Hart et al. | 414/798.6 |
| 6,371,278 | B1 * | 4/2002 | Hart et al. | 198/463.4 |

(Continued)

*Primary Examiner* — Thanh Truong
*Assistant Examiner* — Justin Citrin
(74) *Attorney, Agent, or Firm* — Thomas/Horstemeyer, LLP

(57) ABSTRACT

Sliced products are deposited in a shipping tray 10 by depositing a first row 71 of the sliced products in the center portion of the tray, moving the first row across the bottom of the tray to a first side wall, depositing a second row 72 of sliced products in the center portion of the tray, then moving the second row of sliced products to the opposite side wall, and depositing a third row 73 of the sliced products in the center portion of the tray. The lateral movement of the first and second rows of sliced products avoids obstruction by the perimeter rim of the tray and the endmost slices of the products tend to follow the curvature of the corners 17-20 of the shipping tray as they are moved toward the side walls of the shipping tray.

11 Claims, 13 Drawing Sheets

(56) References Cited

U.S. PATENT DOCUMENTS

| | | | | |
|---|---|---|---|---|
| 6,438,925 | B1 * | 8/2002 | Straub | 53/244 |
| 6,606,841 | B1 * | 8/2003 | Germunson | 53/475 |
| 6,764,267 | B2 * | 7/2004 | Hart et al. | 414/405 |
| 6,799,496 | B2 | 10/2004 | Verhaeghe | |
| 6,899,249 | B2 | 5/2005 | Sanders et al. | |
| 7,861,629 | B2 | 1/2011 | Brander et al. | |
| 2005/0229548 | A1 * | 10/2005 | Hooper | 53/475 |
| 2006/0225547 | A1 | 10/2006 | Stanojevic et al. | |

* cited by examiner

PACKING PROCESS AND APPARATUS FOR MULTIPLE ROWS OF HORIZONTALLY STACKED PRODUCTS

FIELD OF THE INVENTION

This invention concerns a method and apparatus for packing horizontally stacked products in multiple parallel rows in a shipping tray. This method and apparatus is particularly useful to the packaging of sliced fruits and vegetables while practicing gentle care so as to reduce the bruising and loss of juice and texture of the sliced products and reducing the likelihood of misalignment of the products in the shipping tray.

BACKGROUND OF THE DISCLOSURE

When sliced food items, such as sliced tomatoes and sliced onions, are to be used at a restaurant or other food service institution, a substantial amount of preparation time would be required at the restaurant to cut and otherwise prepare the sliced products. Whole food products that are purchased and delivered to the restaurant would have to be cleaned, sliced and made available for placement on salads, sandwiches, or other menu items. It is difficult for the person slicing the food items to prepare slices of uniform width and consistency, and there is a substantial amount of waste because of improper slicing and handling the products.

The owners and managers of a restaurant chain usually desire to present a uniform food product, such as hamburgers of uniform size, appearance and taste, with tomatoes and/or onions applied to the hamburger, with the hamburgers and all of its ingredients being substantially in identical form one restaurant to the other. It is important that tomatoes and onions, in particular, be sliced to a desired thickness when placed on sandwiches, salads, etc. of a restaurant chain. This provides the customer with confidence that the food products will be uniform from one restaurant to the other within the chain of restaurants. Accordingly, restaurant managers prefer to receive food items properly prepared and in proper condition for placement on a sandwich, salad, etc. for immediate service to the customer without preparation steps such as slicing the food products.

Further, the operators of large restaurants prefer to receive tomatoes in a sliced form in a shipping tray that not only supports the tomatoes during storage, delivery, refrigeration, and service, but also in a shipping tray that expedites convenient retrieval of the sliced food product from the shipping tray.

Article slicing methods and machines are disclosed in U.S. Pat. No. 7,861,629, and in Patent Publication No. US-2006/0021484 A1, published Feb. 2, 2006. These publications disclose slicing multiple products, such as tomatoes, simultaneously so that the tomatoes are delivered with their end heels removed and with the central portion of each tomato formed in multiple slices. The multiple slices are gathered or "racked" into a single length of multiple sliced tomatoes and then the tomatoes are deposited in an awaiting shipping tray. Therefore, the prior art shows the concept of delivering multiple tomatoes in sliced form to a delivery mechanism that deposits the tomatoes in a shipping tray. Accordingly, applicant adopts herein, in their entireties, Publication No. US-2006/0021484 A1 and U.S. Pat. No. 7,861,629. There are other article slicers apparently capable of cutting products into slices and gathering the slices of several products together for delivery to a single package.

It is desirable to have the slicing process function rapidly, uniformly, efficiently, and with enough gentle care to not damage the food products, and with the ability to deliver the food products in a handy, attractive condition. For example, it is desirable that tomatoes be sliced and packaged with such gentle care that the juices of the tomato are substantially maintained in the tomato slices, not exuded from the tomato, and that the circular shape of the perimeter of the tomato be maintained without bruising or other damage.

With regard to sliced tomatoes, sliced onions, and other fragile sliced food products that are cut on automated slicers, the most common shipping container for these food products for packing, delivery, and retrieval of the products are shipping trays that accommodate single or double rows of products. The shipping trays are open top trays with opposed side walls spaced apart from one another a distance that is approximately the same as the breadth of one or two breadths of the products to be retrieved and shipped in the shipping tray. The shipping tray has an upper rim that is higher than the height of the contents of the shipping tray so that a protective transparent sheet may be adhesively applied to the rim, thereby closing the shipping tray about the sliced food products.

For three row shipping trays, sliced food products must be loaded by hand in order to properly place the maximum number of the sliced products in the trays. However, there have been efforts to automatically load and ship sliced food products in three row shipping trays that would have three internal spaces, each of which would accommodate a single row of the sliced food products.

For example, FIGS. 1A and 1B illustrate three-row shipping trays that are sized for receiving three rows of sliced products. Both of the illustrated shipping trays include a perimeter rim 11 at the upper edge of the shipping tray, opposed side walls 12 and 13, and opposed end walls 14 and 15. The corners 17-20 of the shipping trays are rounded and extend upwardly from the bottom wall 16 to the rim 11. Rounded corners 17-20 join the opposed side walls to the opposed end walls. The rounded corners 17-20, the perimeter rim 11, the side and end walls and the bottom wall 16 are shaped so as to form a strong structural shape that can receive and maintain three rows of sliced tomatoes or other sliced products and which may be stacked one upon the other after a transparent film has been applied to the perimeter rim 11. The shape of the shipping trays is not only calculated for snugly receiving the sliced products, but also for forming a structural shape of sufficient strength and durability for its intended use.

Non-absorbent shipping trays sized for shipping three rows of sliced products, such as sliced onions, may have a substantially flat bottom surface with parallel ribs. The ribs may be shallow, as shown in FIG. 1A, for shipping dry products, such as sliced onions, or deeper for collecting moisture from moist products, such as sliced tomatoes. A third three row absorbent shipping try is shown in FIG. 1B. This three row shipping tray may be used to pack tomatoes and other products that tend to release moisture and may have upwardly extending ribs 22 formed in the bottom wall for creating a plurality of cavities 24. The ribs help strengthen the shipping trays, and a desiccant or other material may be placed in the cavities 24 for the purpose of absorbing liquid exuded from the work product. A porous film (not shown) may be applied to the ribs to separate the desiccant from the work product received in the shipping tray and to form a substantially flat false bottom in the tray. The ribs 22 may also help to maintain the sliced products in their own rows.

It is desirable to stack the products on their edges in the shipping trays with enough lateral support that they do not become separated or tilted from a vertical attitude. This maximizes the number of slices that can be placed in the shipping tray and tends to avoid the loss of juices from the work product, such as the juices from the slices of tomatoes. This is accomplished by placing enough slices in each row of the shipping tray so that the endmost slices engaged the end walls of the shipping tray and the end walls support the slices in an upstanding attitude.

While the configuration of the three-row shipping tray of FIGS. 1A and 1B has met with some success when loaded by hand, there is a problem in loading the shipping tray directly from an automated slicer with sliced products such as sliced tomatoes, sliced onions, or other sliced products. When the sliced products are moved downwardly into the two side rows of the shipping tray, the rims 11 at the rounded corners 17-20 of the shipping tray interfere with the downward movement of the endmost slices of the products. As shown in FIG. 3, the endmost slices 26 of the outer rows of products project over the rim 11 and tend to engage the rim at the rounded corners 17-20 of the shipping tray at the position where the end walls intersect the side walls, as indicated by numerals 28. The result is that the endmost slices of the horizontally stacked products received directly from an automated slicer are likely to be damaged from being forced into a place where there is no space for receiving them.

Another likely result is that the endmost slices likely will not enter the shipping tray. The non-entry of the endmost slices into the shipping tray presents a problem in that the packing process must be interrupted and the equipment cleaned up in order to continue the packing process.

A solution to this problem is to place shorter stacks of products in the shipping trays so that the products do not engage the rim 11 at the rounded corners 17-20. However, by using this method to overcome the problem, fewer slices are received in the shipping tray and the products typically will be more loosely maintained within the shipping tray and not as likely to maintain the desirable upright positions in the shipping tray. If additional products are to be hand-loaded at the corners of the shipping tray to fill the tray, additional labor costs would be required.

SUMMARY OF THE DISCLOSURE

Generally, this disclosure concerns an improved process and apparatus for packing multiple rows of horizontally stacked sliced products in shipping trays.

An embodiment of the process is to move a shipping tray horizontally to a position beneath an article slicer machine of the type described above, and elevate the shipping tray to reduce the vertical drop of the articles received from the slicer machine to the shipping tray. A first horizontal row of the sliced products is moved downwardly from the article slicer machine and is received in the center portion of the shipping tray. The first row of products is moved laterally from the center portion of the shipping tray toward engagement with the first sidewall of the shipping tray. A second horizontal row of the sliced products is moved downwardly from the slicer machine and is received in the center portion of the shipping tray, adjacent and parallel to the first row of the products. The second row of products is moved from the center portion of the shipping tray away from the first stack of products and toward engagement with the second side wall of the shipping tray, forming an empty space in the center portion of the shipping tray. A third row of the sliced products is moved downwardly from the slicer machine and is received into the center portion of the shipping tray parallel to the first and second rows of the sliced products. This completes the loading of three rows of sliced products in the shipping tray.

A film of transparent material may be applied to the rim of the shipping tray to close the shipping tray about the multiple rows of the sliced products.

All three of the rows of sliced products initially enter the center portion of the shipping tray, so that there is no likelihood of any of the rows of the sliced products engaging the rim 11 at the corners 17-20 of the shipping tray. This reduces the problem of interference by the rim at the rounded corners of the endmost slices entering the shipping tray.

Since the first two rows of sliced products enter the shipping tray at the center portion of the shipping tray and then move toward a side wall, the end most slices of the rows of products follow the curvature of the rounded corners as they move to the side of the shipping tray, so that there is little resistance to the movement of the ends of the rows of sliced products.

Another embodiment of the process includes packing three rows of products in adjacent, parallel rows in a rectangular shipping tray. Placing a first row of products on the bottom wall in the center portion of the shipping tray and parallel to the sidewalls of the shipping tray, moving the first row of the products from the center portion of the shipping tray toward engagement with the first sidewall of the shipping tray, placing a second row of the products on the bottom wall in the center portion of the shipping tray and parallel to the first row of the products, moving the second row of the products from the center portion of the shipping tray across the bottom wall away from the first row of the products and toward engagement with the second sidewall of the shipping tray opposite to the first sidewall of the shipping tray, and placing a third row of the products in the center of the shipping tray parallel to and between the first and second rows of the products.

The products may be selected from the group including but not limited to sliced tomatoes, sliced onions, sliced cucumbers, and other sliced fruits and vegetables.

Another embodiment would be packing three or more rows of sliced products in a shipping tray by placing the rows of the products in the shipping trays in the center portion of the shipping tray and moving guiding gates across the shipping tray to engage and move the rows of products to the sides of the shipping tray. The guiding gates also hold the products in place at the sides of the shipping tray so there is space for the third row of products in the center of the tray. The guiding gates may also become tilted against the first and second rows of products to form a V-shape for receiving the third row of products.

Guiding gates may be used to move the rows of sliced products from the center portion of the shipping trays to the sides of the shipping trays. A shipping tray elevator may be used to lift the shipping trays into registration with the guiding gates, and when the products are deposited in the center portion of the shipping trays the guiding gates are moved from side to side to push the rows of the products from the center portion to the sides to the shipping tray. This may be accomplished without having to move the shipping tray from side to side.

This disclosure is directed to an improvement in the packing process and apparatus for receiving sliced and gathered products in horizontally stacked arrangement in a multiple chamber shipping tray while reducing the problem of loss space in the shipping tray due to rounded corners of the shipping tray and reducing the miss-delivery of the endmost article slices due to insertion of those slices in the portions of the shipping trays having rounded corners.

DETAILED DESCRIPTION

Figure 1B:
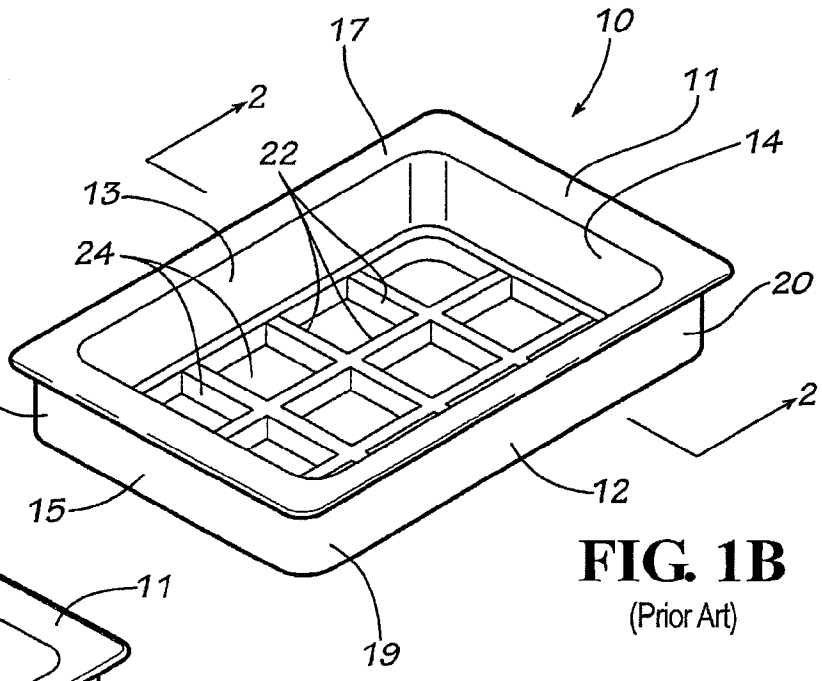
FIG. 1B (Prior Art)
FIG. 1B is a perspective view of a similar prior art three-row shipping tray of suitable shape, dimensions and strength, but with a false bottom, for receiving horizontally stacked sliced food products such as sliced tomatoes, onions, etc.
Figure 1A:
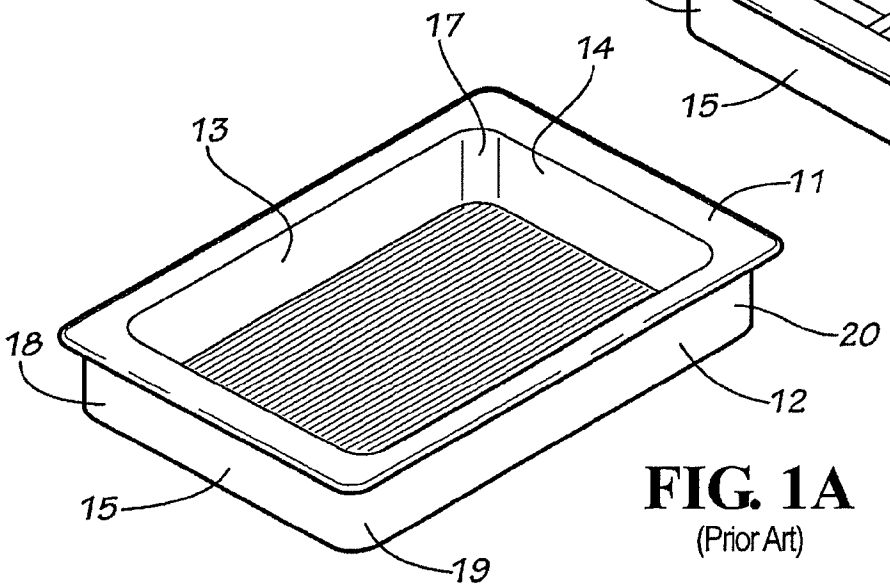
FIG. 1A (Prior Art)
FIG. 1A is a perspective view of a typical prior art three-row shipping tray with suitable shape, dimensions and strength without a false bottom for shipping horizontally stacked food products.
Figure 3:
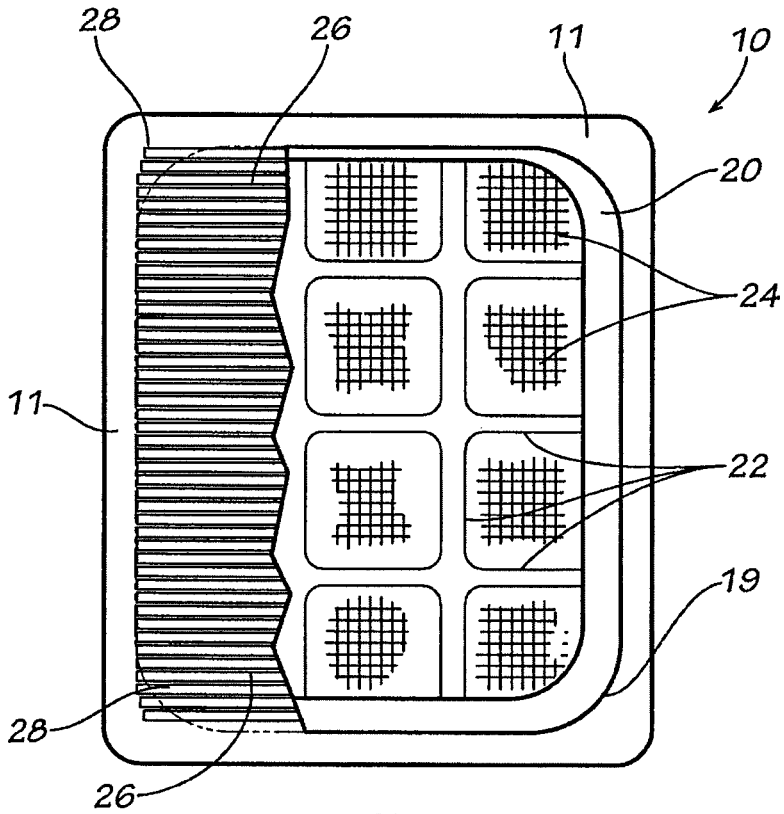
FIG. 3 (Prior Art)
FIG. 3 is a plan view of the shipping tray of FIG. 1B.
Figure 2:
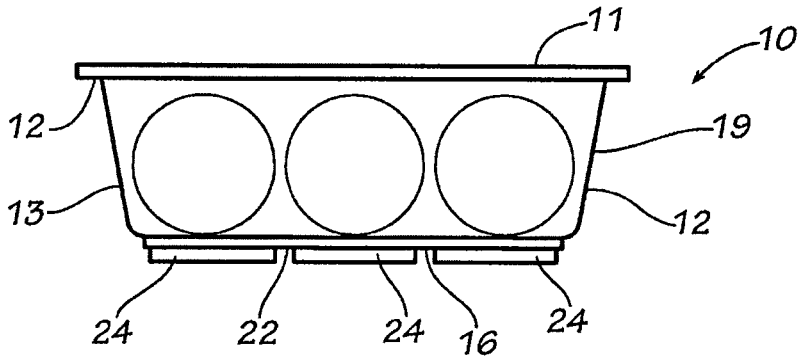
FIG. 2 (Prior Art)
FIG. 2 is an end view of the shipping tray of FIG. 1B, taken along lines 2-2 of FIG. 1B.
Figure 4:
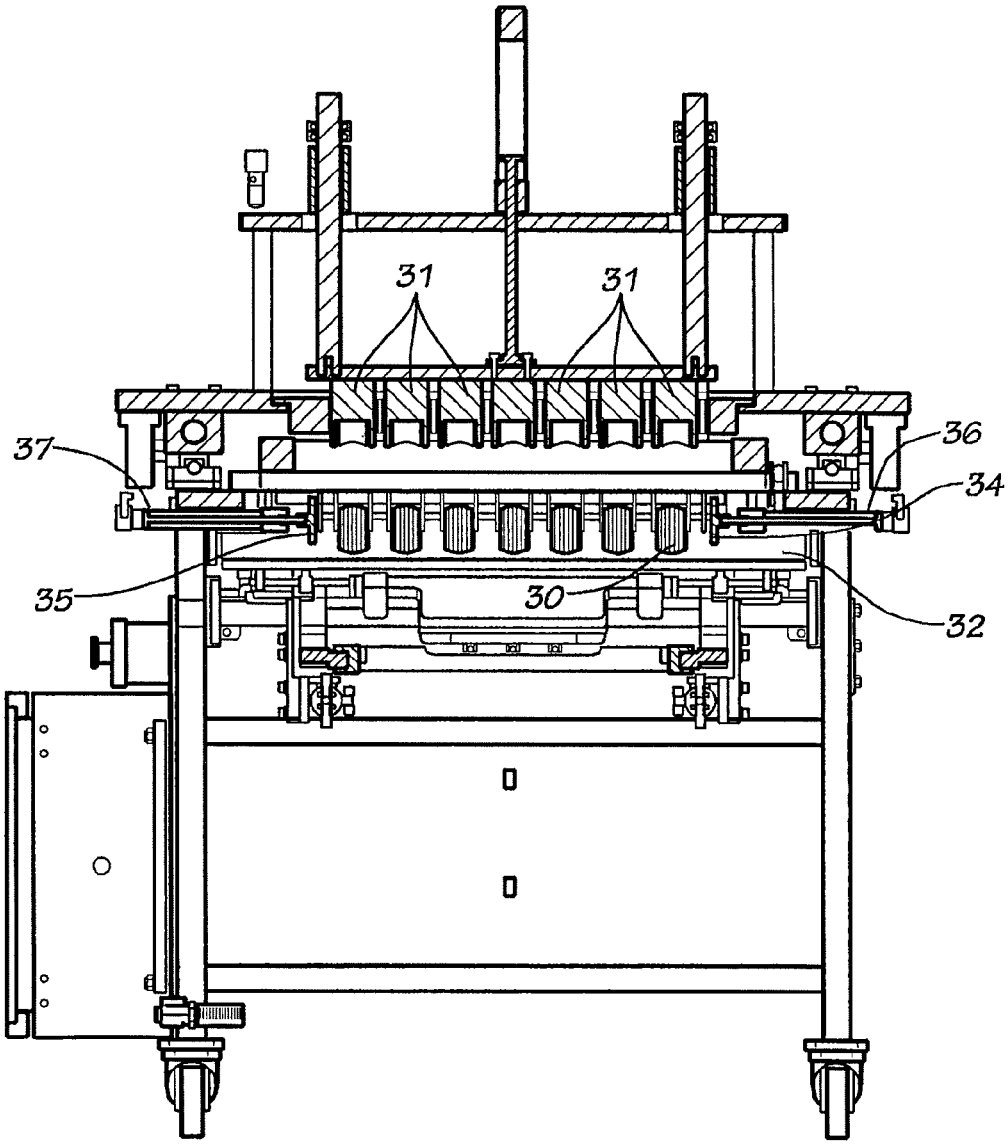
FIG. 4 is a front view of an article slicing machine, showing the products sliced but not yet racked.

Referring now in more detail to the drawings in which like numerals indicate like parts throughout the several views, FIG. 4 is a front view of an article slicing machine that shows several sliced tomatoes 30 that have been pushed downwardly through a plurality of parallel cutter blades (not shown) by pushers 31 and are approaching a transfer tray 32.

Figure 5:
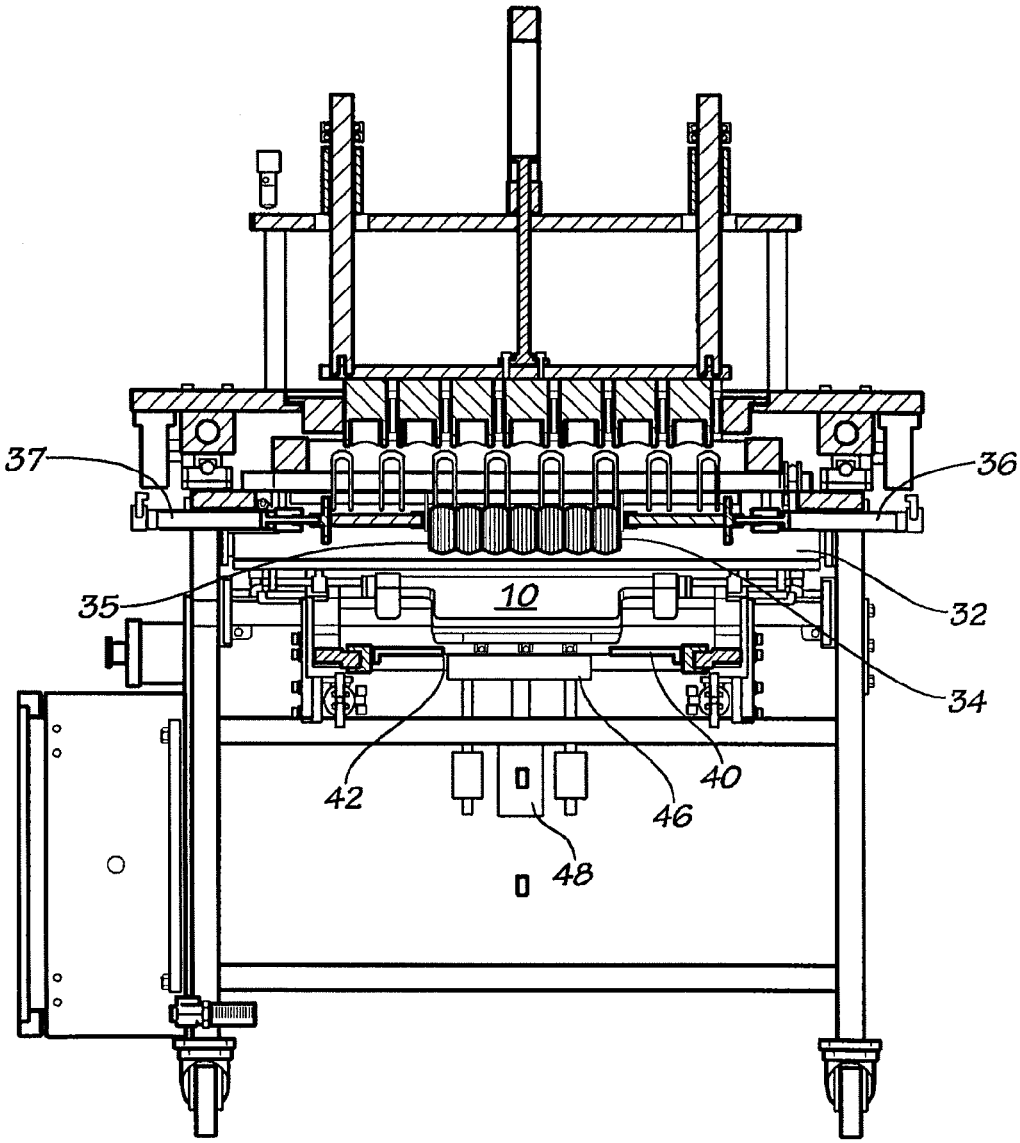
FIG. 5 is a front view of the article slicing machine of FIG. 4, but showing the sliced products after they have been racked and are suspended over a shipping tray.

As shown in FIG. 5, gathering plates 34 and 35 move along the transfer tray toward one another on opposite sides of the sliced tomatoes, tending to gather or "rack" all of the individual groups of slices together. The gathering plates 34 and 35 are moved by their respective cylinders 36 and 37.

Once the tomato slices have been gathered as shown in FIG. 5, the transfer tray, which may be a clam shell transfer tray 32, is opened and the gathered tomatoes move downwardly into the awaiting shipping tray 10. This step is repeated so as to progressively fill the shipping tray with rows of sliced products, as described in more detail hereinafter.

Figure 6:
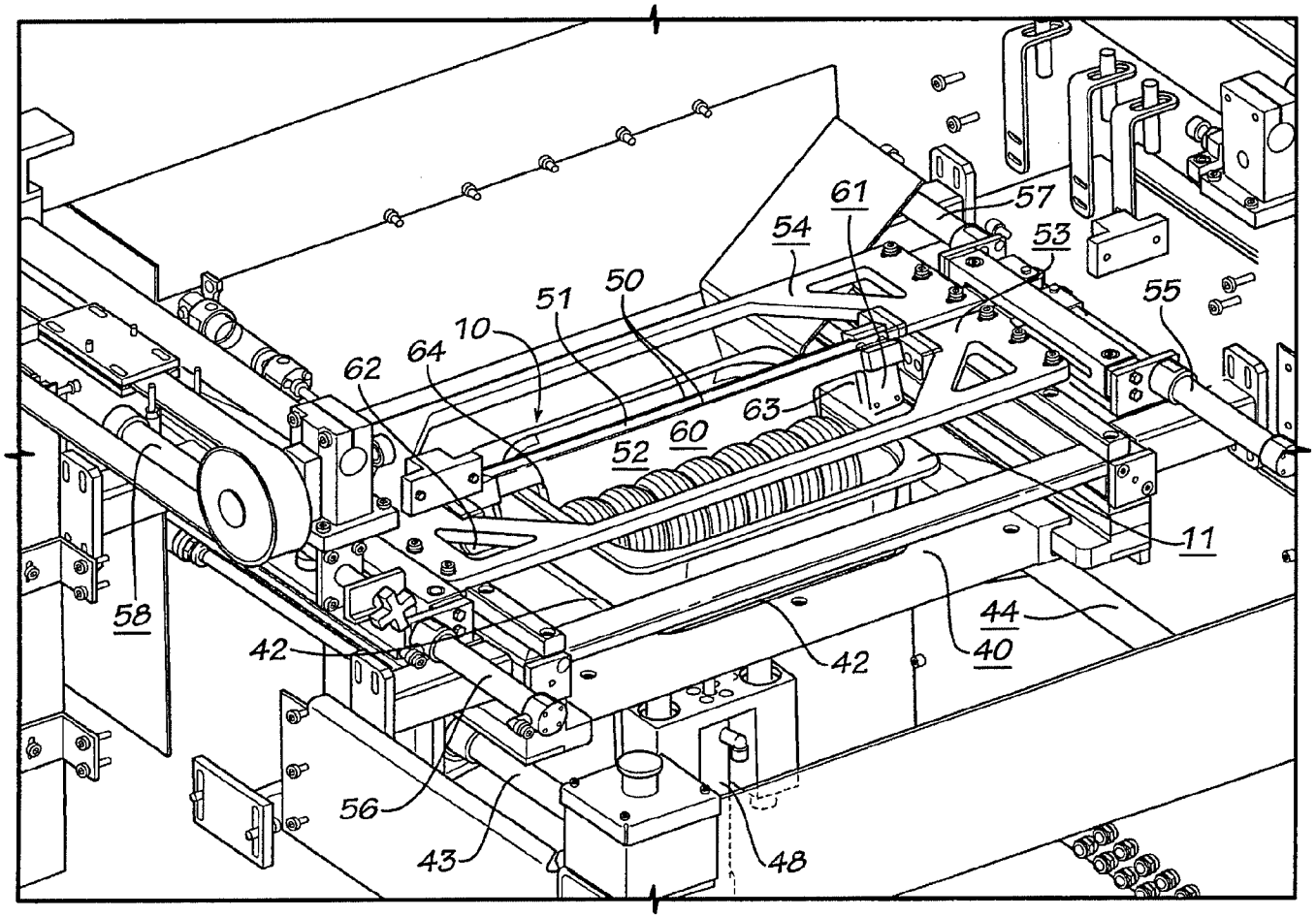
FIG. 6 is a perspective view of the sliding guiding gates that are projected downwardly into the shipping tray after the shipping tray has been elevated to receive the sliced products.
Figure 13:
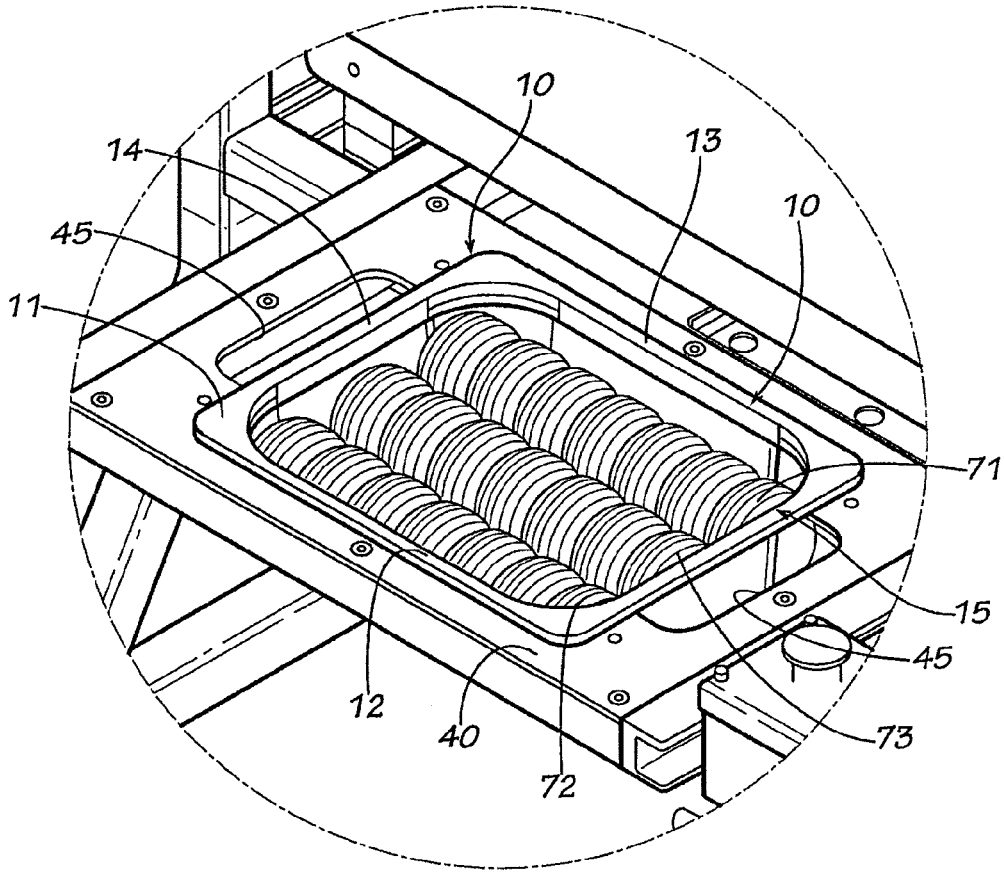
FIG. 13 is a perspective illustration of the shipping tray loaded with three horizontal stacks of sliced tomatoes, with the shipping tray supported by the shipping tray elevator.

As shown in FIGS. 6 and 13, shipping tray support frame 40 comprises a horizontal plate with a central rectangular opening 42 formed therein of a size and shape to receive the opposed side walls 12 and 13 and opposed end walls 14 and 15 of the three row shipping tray, so that the perimeter rim 11 of the shipping tray comes to rest on the facing edges of the shipping tray support frame 40. Hand openings 45 (in FIG. 13) may be formed at the opposite edges of the rectangular opening for use by an operator in lifting the tray from the support frame. If the slicing machine is integrated with an automated denester, the shipping trays will be indexed and supported by a conveyor which may not require a plate or hand openings. The shipping tray support frame 40 is moved horizontally by its cylinders 43 and 44, so as to move the shipping tray between its loading position inside the machine, as shown in FIG. 6, and its retrieving position outside the machine, as shown in FIG. 13.

As shown in FIG. 5, an elevator platform 46 is positioned in alignment with the rectangular opening 42 of shipping tray support frame 40 for the purpose of engaging the bottom surface of the shipping tray 10 and raising the shipping tray to a position just below the clam shell transfer tray 32 and the racked products. A hydraulic cylinder 48 raises and lowers the elevator platform 46 and the shipping tray 10 supported by the elevator platform.

FIG. 6 shows a pair 50 of sliding guiding gates 51 and 52 suspended above the shipping tray support frame and extending downwardly into the space to be occupied by the interior of a shipping tray 10. Each of the guiding gates 51 and 52 are supported by a gate frame 53, 54, respectively. Gate frames 53 and 54 are each supported on horizontal and parallel rails, and are moved horizontally across the rectangular opening 42 of the shipping tray support frame 40. Cylinders 55 and 56 move gate frame 53, and cylinders 57 and 58 move gate frame 54 The gate frames and cylinders function as gate transports.

Figure 15:
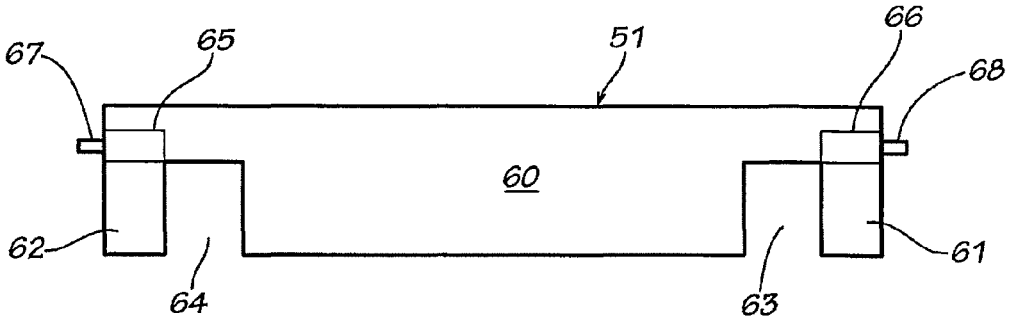
FIG. 15 is a front view of a guiding gate.

As shown in FIGS. 6 and 15, guiding gates 51 and 52 are substantially identical in that each include an engaging panel 60 for being suspended downwardly into a shipping tray 10, end protrusions 61 and 62 that are spaced laterally from and in alignment with the engaging panel 60, and slots 63, 64 positioned between the engaging panel 60 and the end protrusions 61 and 62, respectively. The slots 63 and 64 are sized and shaped to receive the opposed end walls 14 and 15 of the shipping tray 10.

Figure 14:
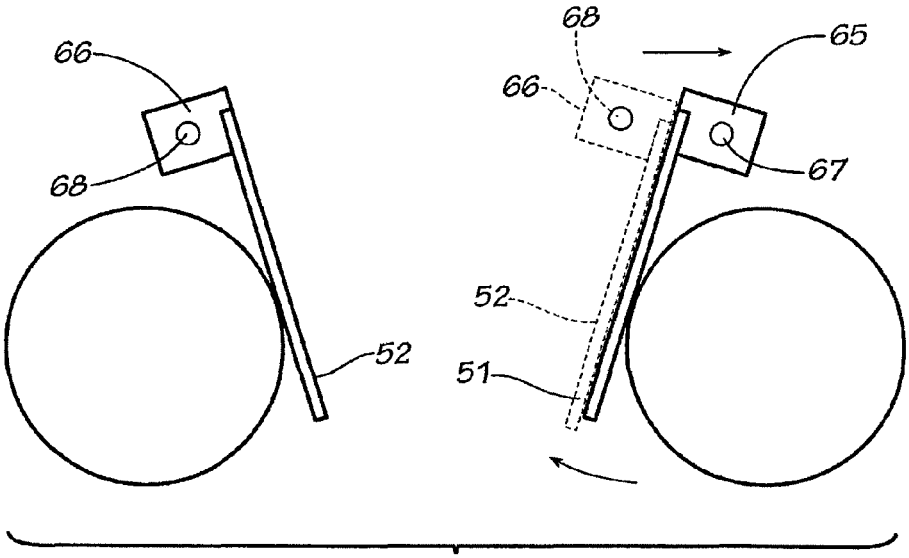
FIG. 14 shows the guiding gates, indicating the movement of one of the guiding gates from its dash line position to its full line position, engaging and holding one row of products to the left and the other sliding gate holding the other row of products to the right, and the two guiding gates forming a V-shape to control the entry of a third row of products.

As shown in FIG. 14, the sliding guiding gates 51 and 52 are substantially flat and are mounted at their upper ends to connector blocks 65 and 66 that are pivotally supported by pivot pins 67 and 68, respectively. The pivot pins are mounted in the gate frames 53 and 54 so that the guiding gates 51 and 52 slide independently of each other, in accordance with the forces applied by their respective cylinders 55, 56, 57 and 58.

Figure 8B:
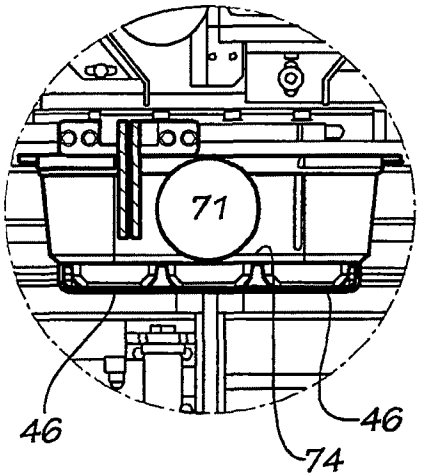
FIG. 8B is an end cross-sectional view, taken along lines 8B-8B of FIG. 8A.
Figure 8A:
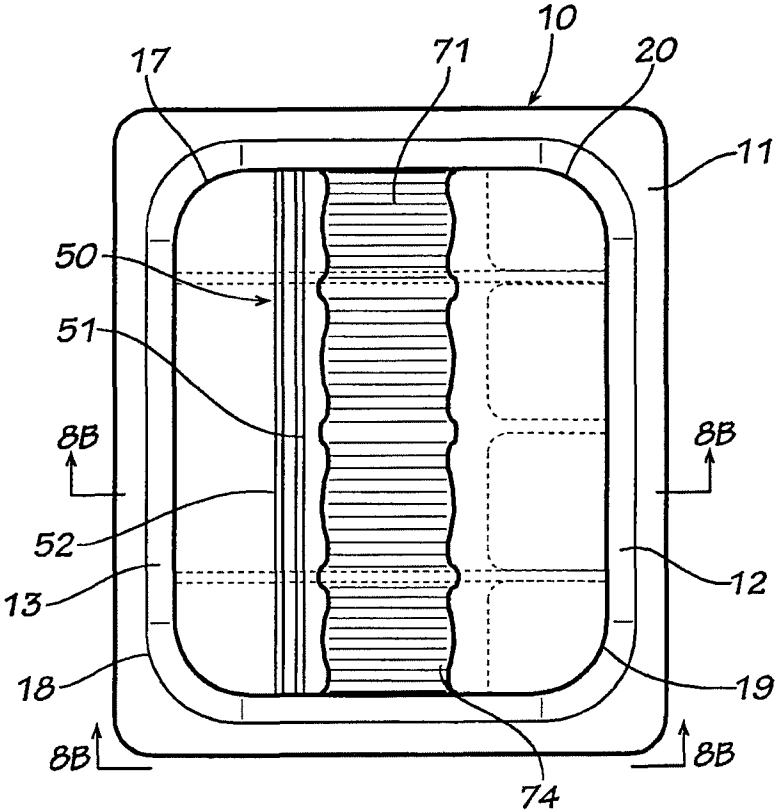
FIG. 8A is a plan view of a shipping tray that has received a single row of sliced tomatoes, with the sliced tomatoes in the center of the shipping tray and both of the sliding guiding gates positioned on one side of the tomatoes.

FIGS. 8A and 8B illustrate a shipping tray 10 that has been placed on the elevator platform 46 and raised up into close proximity with respect to the clam shell transfer tray 32 (FIGS. 4 and 5). The clam shell transfer tray 32 functions to deposit rows of the sliced products in sequence into the shipping tray. FIGS. 8A and 8B illustrate a three row shipping container 10 as described above, having a perimeter rim 11 and opposed side walls 12 and 13, with rounded corners 17-20.

The first row 71 of sliced products is deposited in the center portion 74 of the shipping tray 10 and is received as shown in FIG. 8A.

The pair of guiding gates 50 is positioned to the left of the center portion 74 of the shipping tray when the first row of sliced products is received in the tray.

Figure 9B:
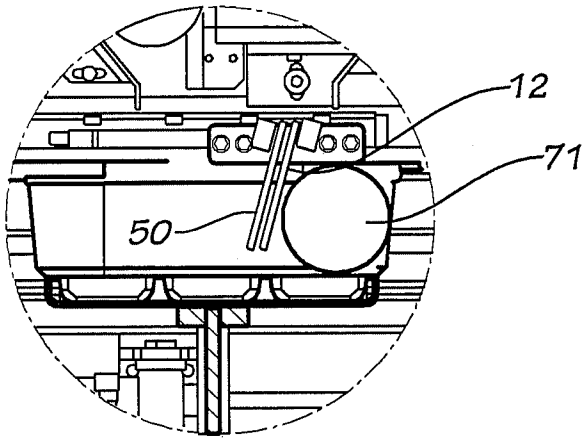
FIG. 9B is an end cross-sectional view, taken along lines 9B-9B of FIG. 9A.
Figure 9A:
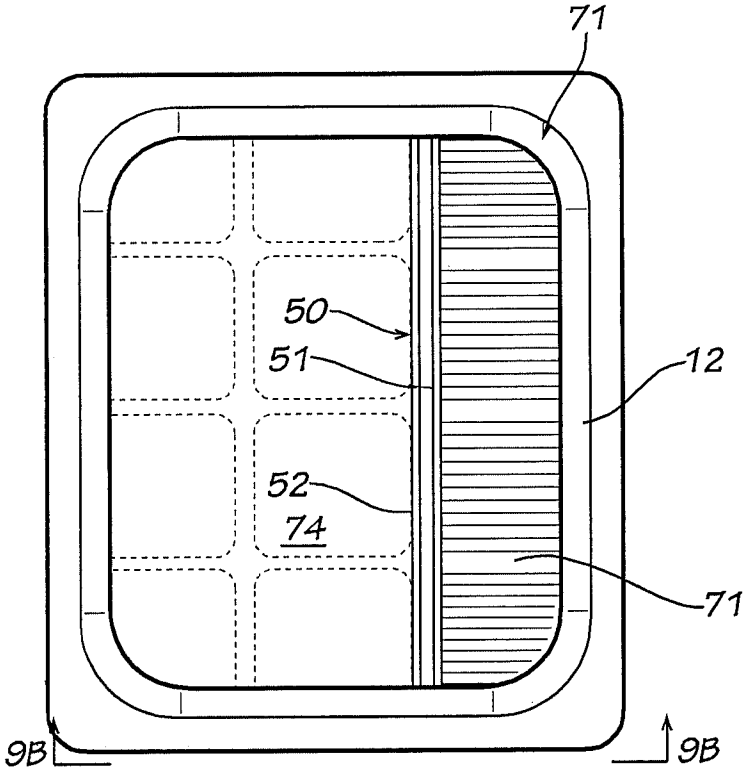
FIG. 9A is a plan view of a shipping tray that has received a single row of sliced tomatoes, with the sliced tomatoes in the right side of the shipping tray and both of the sliding guiding gates positioned adjacent one side of the tomatoes.

Before the delivery of the second row of sliced products, the pair of guiding gates 50 move from the left toward the right from the position shown in FIGS. 8A and 8B to the right position as shown in FIGS. 9A and 9B. This urges the sliced products to the right, against the right side wall 12. Usually, the pair of guiding gates 50 will be tilted in response to the engagement of the guiding gates with the row 71 of sliced products, as shown in FIG. 9B. This assures that the sliced products make and maintain positive contact with the side wall 12. Also, the guiding gates separate the first row 71 of sliced products from the oncoming row.

Figure 10B:
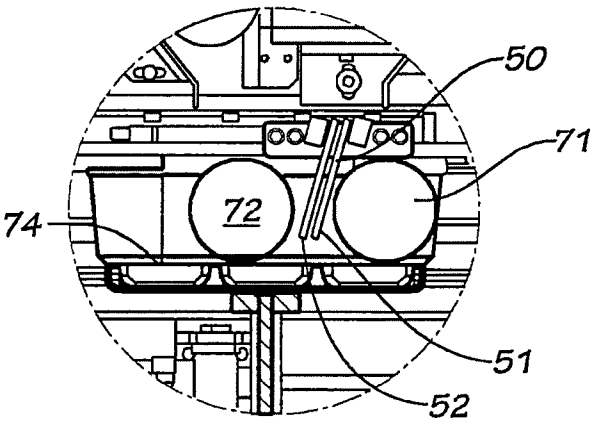
FIG. 10B is an end cross-sectional view, taken along lines 10B-10B of FIG. 10A.
Figure 10A:
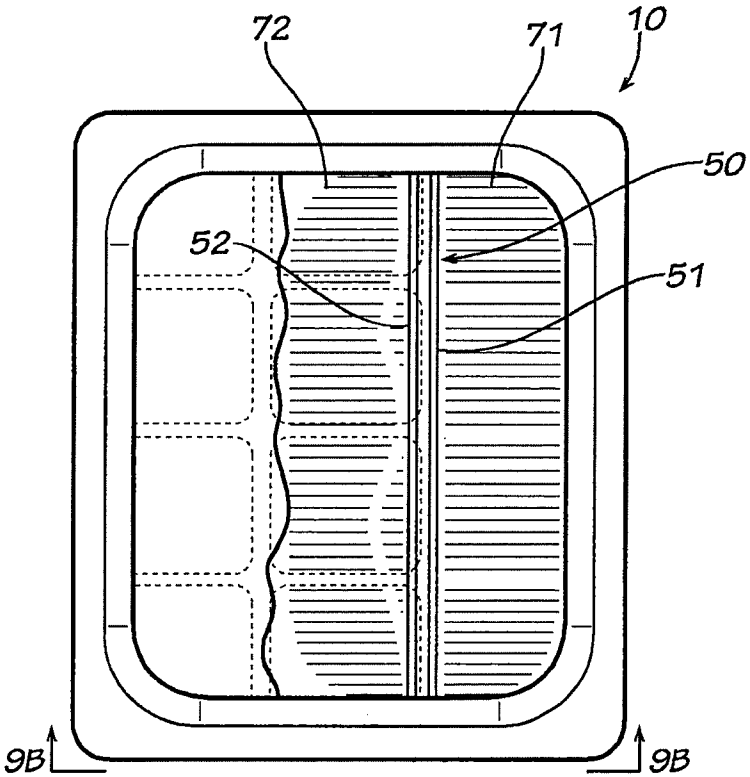
FIG. 10A is a plan view of a shipping tray that has received a second row of sliced tomatoes in the center of the shipping tray and both of the sliding guiding gates positioned between the rows of the tomatoes.
Figure 11B:
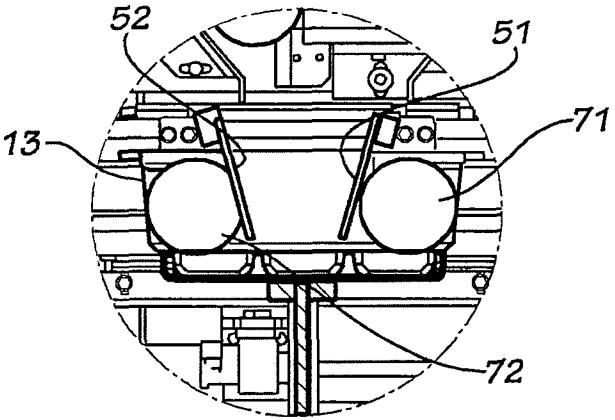
FIG. 11B is an end cross-sectional view, taken along lines 11B-11B of FIG. 11A.
Figure 11A:
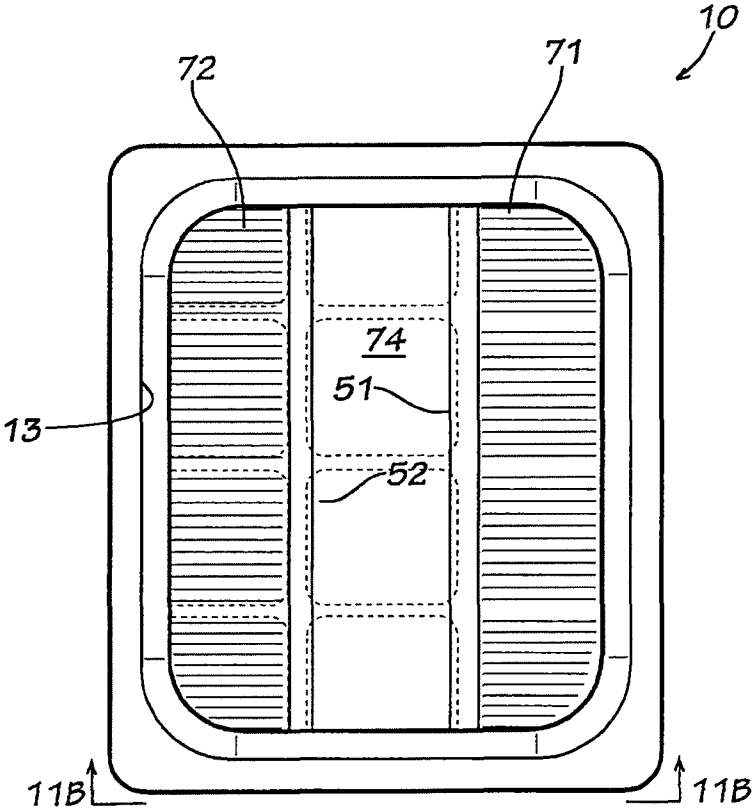
FIG. 11A is a plan view of a shipping tray that has received two rows of sliced tomatoes, with the second row of sliced tomatoes moved to the left in the shipping tray and both of the sliding guiding gates positioned on one side of the tomatoes and oriented in a V-shape.

As shown in FIGS. 10A and 10B the second row 72 of sliced products is deposited in the central portion 74 of the tray 10. The guiding gate 52 then moves away from the first guiding gate 51 to the left from the position shown in FIGS. 10A and 10B to the position shown in FIGS. 11A and 11B, until the second row of sliced products move to the side wall 13 to the left of the center portion 74. This leaves the center portion open, with the guiding gates positioned in a V shape, generally straddling the center portion 74 of the shipping tray 10. As shown in FIG. 14, both of the guiding gates 51 and 52 are tilted into engagement with their respective first and second rows of sliced products.

Gate frame 53, 54, function as means for tilting the first and second guiding gates in response to engaging the products with the guiding gates.

Figure 12B:
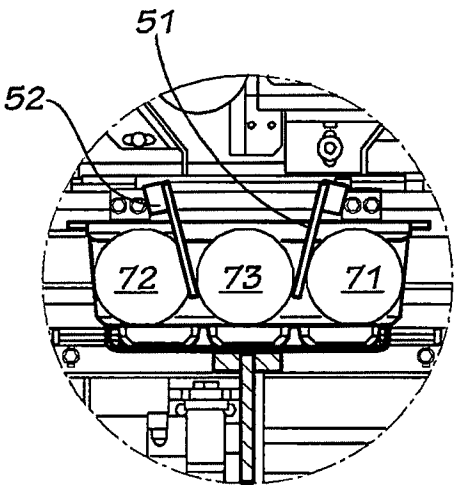
FIG. 12B is an end cross-sectional view, taken along lines 12B-12B of FIG. 12A.
Figure 12A:
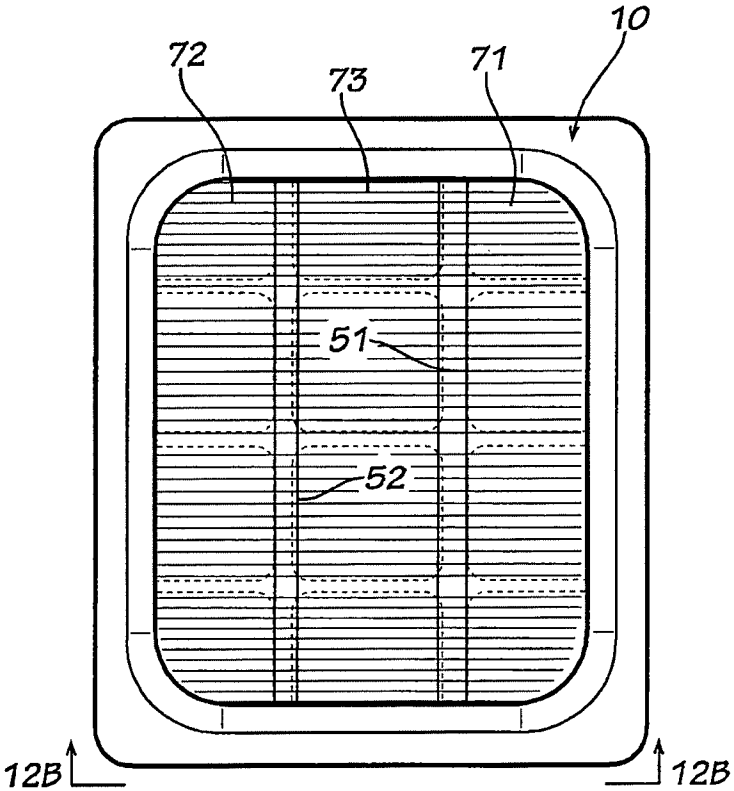
FIG. 12A is a plan view of a shipping tray that has received a third row of sliced tomatoes, with the sliced tomatoes in the center of the shipping tray and sliding guiding gates positioned between the rows of the tomatoes.

The third row 73 of sliced products is then deposited in the shipping tray 10, as shown in FIGS. 12A and 12B.

The V-shape formed by the guiding gates 51 and 52 (FIG. 11B) tends to guide the third row 73 (FIGS. 12A and 12B) of the sliced products into the center portion 74 of the shipping tray without the likelihood of intermingling of the rows of sliced products, tending to form a slight separation between the rows of sliced products.

Figure 7:
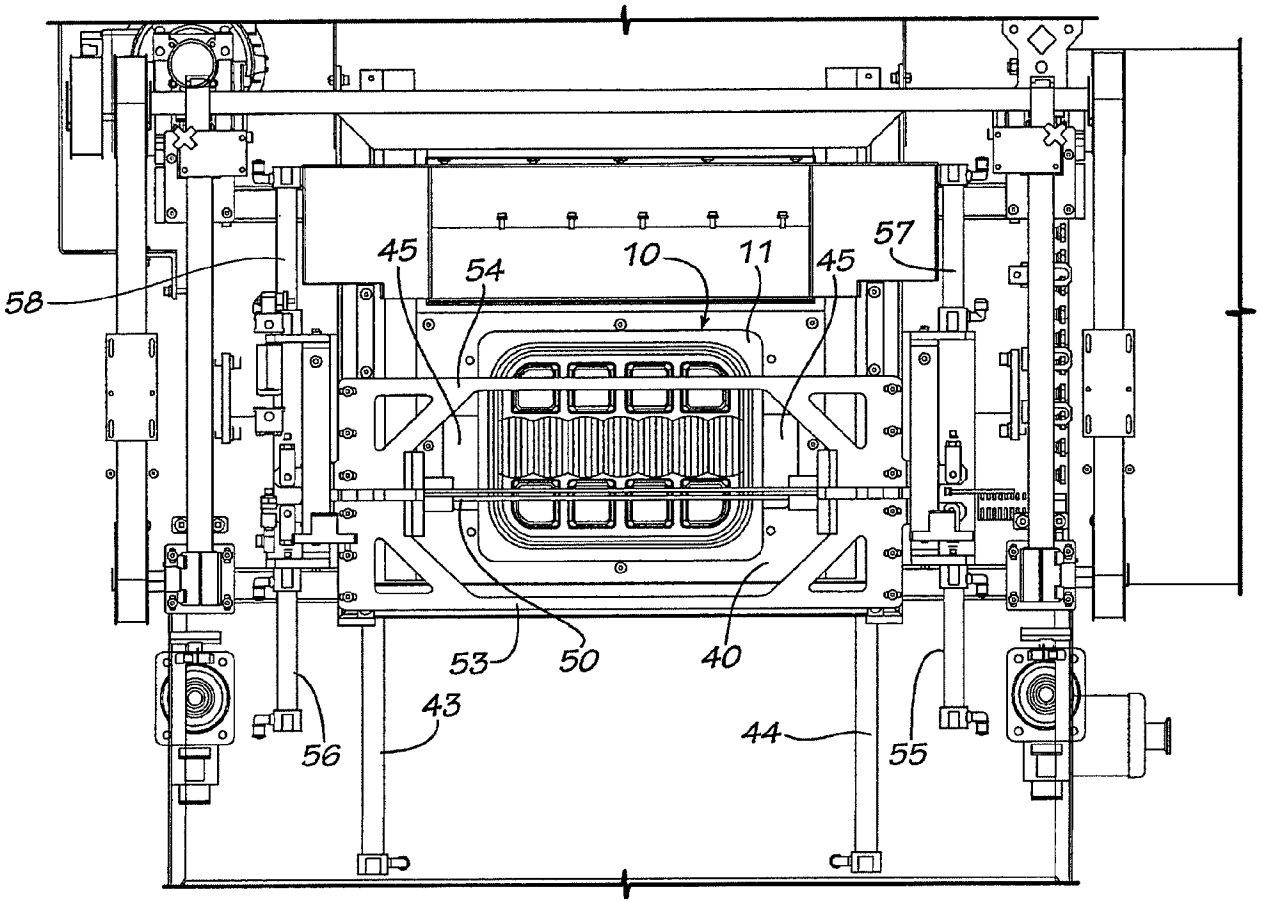
FIG. 7 is a top view of the shipping tray, showing a single row of products that have been inserted into the shipping tray, and the support apparatus for the sliding guiding gates that handle the positions of the tomatoes.

Once the configuration of three rows of sliced products has been achieved as shown in FIGS. 12A and 12B, the elevator platform 46 is lowered, bringing the shipping tray 10 down into its rectangular opening 42 (FIGS. 6 and 7) of the container support frame 40. The downward movement of the tray withdraws the tomatoes from the vicinity of the pair of guiding gates 50. The guiding gates remain suspended out of the vicinity of the sliced products, so that they can return to their initial positions as shown in FIGS. 8A and 8B.

It should be noted that all of the rows 71, 72 and 73 of the sliced products are first deposited in the center portion 74 of the shipping tray 10, away from the rounded corners 17-20. Therefore, the endmost products of all three rows are received at the widest dimension of the shipping tray, and the endmost products are not likely to be obstructed by the perimeter rim 11 of the shipping tray as they move downwardly into the tray.

Once the first and second rows of products have been deposited in the shipping tray and begin to move toward a side wall, the endmost products of these rows generally follow the curvature of the rounded corners 17-20 of the side walls of the shipping tray as they approach the rounded corners of the shipping tray. This procedure avoids the hazard of the endmost products in each row being obstructed by the perimeter rim 11 at the rounded corners 17-20.

While this disclosure describes the movement of the rows of products into "rounded corners" of shipping trays, it will be understood that this term is to include other shapes of non-right angle corners, such as but not limited to angled corners and other non-linear corners of the tray. Further, the process disclosed herein may be used for packing trays with rectangular corners.

Although a preferred embodiment of the invention has been disclosed in detail herein, it will be obvious to those skilled in the art that variations and modifications of the disclosed embodiment can be made without departing from the spirit and scope of the invention as set forth in the following claims.

The invention claimed is:

1. A process of packing three rows of horizontally stacked products each having opposed ends in adjacent, parallel rows in a rectangular shipping tray having a bottom wall with a center portion, first and second opposed parallel side walls on opposed sides of the center portion of the shipping tray and opposed parallel end walls intersecting the side walls, with rounded corners at the intersections of the side walls with the end walls, comprising:

placing a first stack of the products onto the bottom wall in the center portion of the shipping tray and parallel to the side walls, moving the first stack of the products from the center portion of the bottom wall of the shipping tray toward engagement with the first side wall of the shipping tray with the opposed ends of the first stack of the products engaging and conforming to the rounded corners at the first side wall of the shipping tray, placing a second stack of the products in the center portion of the bottom wall of the shipping tray and parallel to the first stack of the products, moving the second stack of the products from the center portion of the bottom wall of the shipping tray across the bottom wall away from the first stack of the products and toward engagement with the second side wall of the shipping tray opposite to the first side wall of the shipping tray with the opposed ends of said second stack of the products engaging and conforming to the rounded corners at the second side wall of the shipping tray, and placing a third stack of the products in the center portion of the bottom wall of the shipping tray parallel to and between the first and second stacks of the products.

2. The process of claim 1, wherein the products are sliced products.

3. The process of claim 1 wherein the products are bendable at the opposed ends of the stacks.

4. The process of claim 1 wherein the products are food items selected from the group of fruits and vegetables.

5. A process of packing multiple rows of products having opposed ends in adjacent parallel rows in a rectangular shipping tray having first and second opposed side walls on opposed sides of a center portion of the shipping tray and opposed end walls, with non-right angle corners extending inwardly at the intersections of the side walls with the end walls, comprising:

placing a first stack of the products in the center portion of the shipping tray and parallel to the side walls, moving the first stack of the products from the center portion of the shipping tray into engagement with the first side wall of the shipping tray with one of the opposed ends of the first stack of the products engaging and conforming to the shape of at least one of the non-right angle corners at the first side wall of the shipping tray, placing a second stack of the products in the center portion of the shipping tray and parallel to the side walls moving the second stack of the products away from the first stack of the products and toward engagement with the second side wall of the shipping tray opposite to the first side wall of the shipping tray with one of the opposed ends of said second stack of the products engaging and conforming to one of the non-right angle corners at the second side wall of the shipping tray, placing at least one additional stack of the products in the center portion of the shipping tray parallel to and between the first and second stacks of the products.

6. The process of claim 5, wherein the products are selected from the group consisting of sliced fruits and vegetables.

7. The process of claim 5, and further including a step of lifting the tray to a position where the products are placed in the tray.

8. A process of placing multiple rows of horizontally stacked sliced products in a shipping tray that includes a bottom wall with a center portion and first and second opposed side walls comprising:

placing a first row of products on the bottom wall in the center portion of the shipping tray, moving the first row of products from the center portion of the shipping tray toward the first side wall of the shipping tray, placing a second row of products on the bottom wall in the center portion of the shipping tray, moving the second row of products from the center portion of the shipping tray toward the second side wall of the shipping tray, placing a third row of products in the center portion of the shipping tray between the first and second rows of products.

9. The process of claim 8, and further including a step of placing first and second guiding gates in the shipping tray between the first and second side walls, moving the first and second guiding gates from a first side of the center portion of the shipping tray to a second side of the center portion of the shipping tray and as the first and second guiding gates move toward the second side of the center portion of the shipping tray urging with the first guiding gate the first row of products from the center portion of the shipping tray toward the first side wall, moving the second guiding gate from the second side of the center portion of the shipping tray to the first side of the center portion of the shipping tray and as the second guiding gate moves toward the first side of the center portion of the shipping tray urging with the first guiding gate the second row of products from the center portion of the shipping tray toward the first side wall and forming a space between the first and second guiding gates for receiving a third row of products.

10. The process of claim 9, and further including a step of tilting the first and second guiding gates in response to urging the products with the guiding gates.

11. The process of claim 9, and further including a step of tilting the first and second guiding gates in a V-shape with each other when the second guiding, gate has urged the second row of products toward the second side wall.

* * * * *